United States Patent [19]

Granzow et al.

[11] Patent Number: 4,521,008

[45] Date of Patent: Jun. 4, 1985

[54] FAIL SAFE DOCUMENT DISPENSING SYSTEM

[75] Inventors: Robert H. Granzow, Miamisburg; Desh B. Gupta, Dayton; Kimbrough I. Myers, Kettering; Mark D. Filliman, Beavercreek, all of Ohio

[73] Assignee: NCR Corporation, Dayton, Ohio

[21] Appl. No.: 471,921

[22] Filed: Mar. 3, 1983

[51] Int. Cl.[3] ..... B65H 5/22

[52] U.S. Cl. ..... 271/3; 271/9; 271/110; 271/265; 271/305

[58] Field of Search ..... 271/9, 3, 110, 265, 271/154, 155, 305, 303; 221/103, 110

[56] References Cited

U.S. PATENT DOCUMENTS

| | | | |
|---|---|---|---|
| 3,070,204 | 12/1962 | Bradshaw | 197/130 |
| 3,222,057 | 12/1965 | Couri | 271/3 |
| 3,648,020 | 3/1972 | Tateisi et al. | 235/61.7 B |
| 3,651,986 | 3/1972 | Karecki et al. | 221/12 |
| 3,675,816 | 7/1972 | Bourke et al. | 221/13 |
| 3,880,298 | 4/1975 | Habegger et al. | 214/11 R |
| 3,954,260 | 5/1976 | Morello et al. | 271/12 |
| 4,020,972 | 5/1977 | Lundblad | 221/13 |
| 4,025,758 | 5/1977 | Hatanaka et al. | 235/61.7 R |
| 4,075,460 | 2/1978 | Gorgens | 235/420 |
| 4,179,031 | 12/1979 | Ward | 209/534 |
| 4,249,163 | 2/1981 | Maurer et al. | 340/149 A |
| 4,265,440 | 5/1981 | Shibazaki | 271/9 |
| 4,282,424 | 8/1981 | Hirose | 235/379 |
| 4,321,671 | 3/1982 | Ohsako | 364/405 |
| 4,343,582 | 8/1982 | Lundblad | 414/32 |
| 4,363,584 | 12/1982 | Kokubo | 271/9 |

FOREIGN PATENT DOCUMENTS

| | | |
|---|---|---|
| WO82/03287 | 9/1982 | PCT Int'Appl. . |
| 2059391 | 4/1981 | United Kingdom . |
| 2073711 | 10/1981 | United Kingdom . |

OTHER PUBLICATIONS

IBM Technical Disclosure Bulletin, vol. 16, No. 3, pp. 906–911, Aug. 1973, "Opposed Feed Transports Having Shared Stackers", L. L. Amundson et al.

IBM Technical Disclosure Bulletin, vol. 20, No. 2, pp. 758, 759, Jul. 1977, "Currency Feed Mechanism", J. J. Lynott et al.

*Primary Examiner*—Richard A. Schacher

*Attorney, Agent, or Firm*—Albert L. Sessler, Jr.; George Jameson

[57] ABSTRACT

A system and method are disclosed for automatically and mutually sharing the currency dispensers in adjacent automatic teller machines when one dispenser is either out of service because of a malfunction or out of currency. In a preferred embodiment of the invention the system is comprised of first and second article dispensers, first and second output stations, a transport mechanism operationally coupled to both dispensers and to both stations, first and second diverters respectively positioned in first and second paths through the transport mechanism and a control circuit for selectively controlling the operations of the dispensers and diverters during a dispensing operation.

19 Claims, 14 Drawing Figures

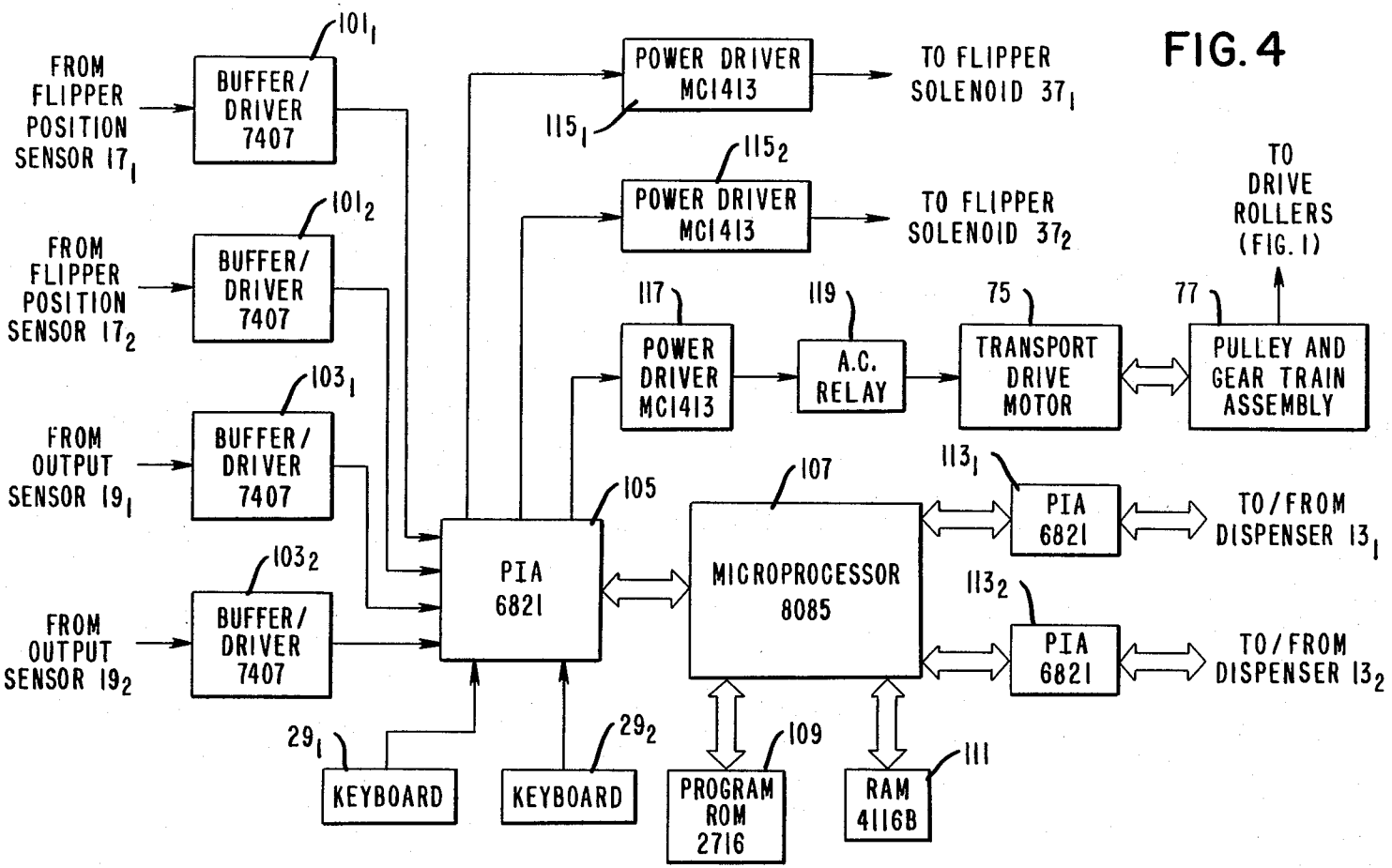
FIG. 4
TO DRIVE ROLLERS (FIG. 1)
PULLEY AND GEAR TRAIN ASSEMBLY
77
TO/FROM DISPENSER 13₁
TO/FROM DISPENSER 13₂
TO FLIPPER SOLENOID 37₁
TO FLIPPER SOLENOID 37₂
TRANSPORT DRIVE MOTOR
75
PIA 6821
113₁
PIA 6821
113₂
111
RAM 4116B
A.C. RELAY
119
MICROPROCESSOR 8085
107
109
PROGRAM ROM 2716
POWER DRIVER MC1413
115₂
POWER DRIVER MC1413
117
POWER DRIVER MC1413
115₁
105
29₂
KEYBOARD
PIA 6821
KEYBOARD
29₁
101₁
BUFFER/ DRIVER 7407
101₂
BUFFER/ DRIVER 7407
103₁
BUFFER/ DRIVER 7407
103₂
BUFFER/ DRIVER 7407
FROM FLIPPER POSITION SENSOR 17₁
FROM FLIPPER POSITION SENSOR 17₂
FROM OUTPUT SENSOR 19₁
FROM OUTPUT SENSOR 19₂

FAIL SAFE DOCUMENT DISPENSING SYSTEM

BACKGROUND OF THE INVENTION

The present invention relates to systems for dispensing articles such as documents and particularly to a system in which the currency dispensers of two adjacent automatic teller machines may be shared between the two machines under certain operational conditions.

A currency dispenser for automatically dispensing a required amount of money as desired by a customer-operator of the machine is well known in the art. However, the reliability of a currency dispenser is of extreme importance, particularly when the currency dispenser is not supervised in any direct manner. For example, considerable inconvenience may be caused to customers if, upon the entry of authorized-customer requests, the machine fails to operate because the dispenser malfunctions or is out of cash.

The present invention relates to article dispensing means and is specifically adapted to minimize the down time of a currency dispenser in an ATM by selectively sharing that currency dispenser with a currency dispenser in an adjacent ATM. Such sharing of the currency dispensers in adjacent ATMs will automatically occur when one currency dispenser is either out of service because of a malfunction or out of currency.

The background art known to the applicants at the time of the filing of this application is as follows:

- U.S. Pat. No. 3,070,204, Sheet Handling Apparatus, by R. S. Bradshaw;
- U.S. Pat. No. 3,222,057, Apparatus and Method for Controlling and Receiving And/Or Dispensing Paper Money, by J. M. Couri;
- U.S. Pat. No. 3,648,020, Automatic Deposit-Receiving And Cash-Dispensing System, by K. Tateisi et al;
- U.S. Pat. No. 3,651,986, Credit Card Automatic Currency Dispenser, by M. R. Karecki et al;
- U.S. Pat. No. 3,675,816, Currency Dispensing Apparatus, By E. R. Bourke, II et al;
- U.S. Pat. No. 3,880,298, Sorting Conveyor Control System, by J. D. Habegger et al;
- U.S. Pat. No. 3,954,260, Paper Money Dispensing Mechanism, by H. Morello et al;
- U.S. Pat. No. 4,020,972, Banknote Dispensing Machine, by L. Lundblad;
- U.S. Pat. No. 4,025,758, Automatic Money-Issuing Apparatus, by Y. Hatanaka et al;
- U.S. Pat. No. 4,075,460, Cash Dispensing System, by R. A. Gorgens;
- U.S. Pat. No. 4,179,031, Document Dispensing System, by S. W. Ward;
- U.S. Pat. No. 4,249,163, Automatic Money Dispenser And Method, by T. Maurer et al;
- U.S. Pat. No. 4,282,424, Automatic Cash Dispensing Machine, by M. Hirose;
- U.S. Pat. No. 4,321,671, Bank Note Dispensing Method And Apparatus, by K. Ohsako; and
- U.S. Pat. No. 4,343,582, Banknote Dispensing Apparatus, by L. J. I. Lundblad et al.

SUMMARY OF THE INVENTION

In a preferred embodiment of the invention there is provided a system comprised of first and second article dispensers, first and second output stations, a transport mechanism operationally coupled to both dispensers and to both stations, first and second diverters respectively positioned in first and second paths through the transport mechanism and a control circuit for selectively controlling the operations of the dispensers and diverters during a dispensing operation.

In normal operation, upon receiving a request for a desired number of articles such as documents from a customer at one of the output stations, the control circuit enables the associated dispenser to feed documents into that dispenser's associated path in the transport mechanism, past its associated diverter, to the customer-requested output station.

When the associated dispenser of a customer-requested output station is either inoperative due to a malfunction or is out of documents, the control circuit enables the other dispenser to feed documents into its associated path in the transport mechanism. The control circuit also causes the diverter in that other dispenser's associated path to divert documents from that other dispenser to the customer-requested output station.

It is, therefore, an object of this invention to provide an improved, more reliable system and method for automatically dispensing articles.

Another object of this invention is to provide an improved system and method for automatically dispensing currency in response to an approved request.

Another object of this invention is to provide a shared currency dispensing system to enable customers of a first ATM machine to make currency withdrawals from a currency dispenser in a second ATM machine when the currency dispenser associated with the first ATM machine is either inoperative or out of currency.

Another object of this invention is to reduce the down time of an ATM machine.

A further object of this invention is to provide a system and method for sharing the currency dispensers of two adjacent ATM machines when one dispenser is either inoperative or out of currency.

BRIEF DESCRIPTION OF THE DRAWINGS

These and other objects, features and advantages of the invention, as well as the invention itself, will become more apparent to those skilled in the art in the light of the following detailed description taken in consideration with the accompanying drawings wherein:

FIG. 4 is a schematic block diagram of a control circuit which may be used with this invention;

DESCRIPTION OF THE PREFERRED EMBODIMENT

Figure 1:
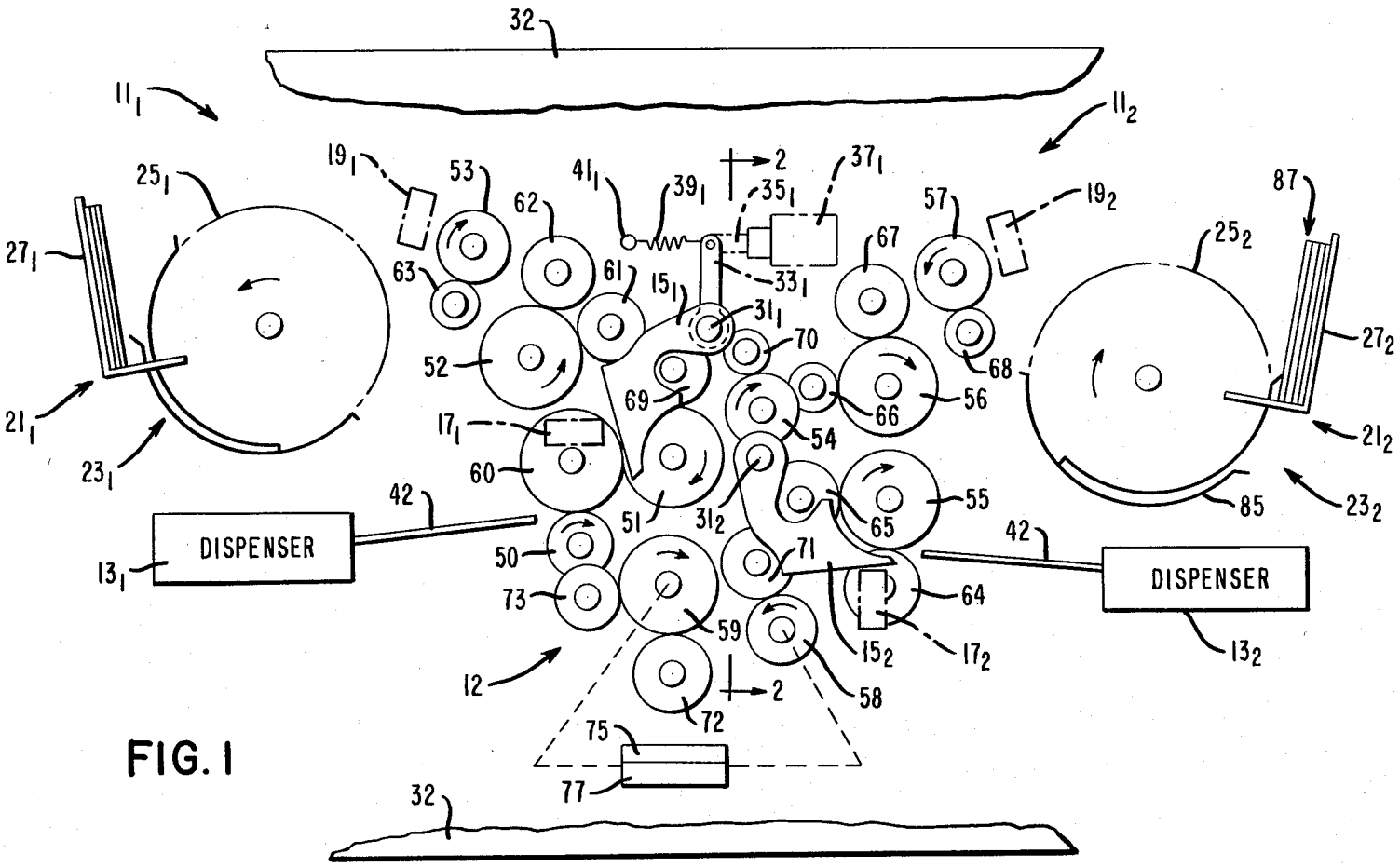
FIG. 1 is a schematic diagram of a side view of a preferred embodiment of the invention.

Referring now to the drawings, FIG. 1 discloses a schematic diagram of a side view of the fail safe document dispensing system of the invention. Although the invention will now be described in relation to a fail safe currency or bill dispensing system for adjacent automatic teller machines (ATMs), it should be realized that the invention could be utilized more broadly in any other system for dispensing any other type of document.

The system shown in FIG. 1 includes first and second ATM units or machines $11_1$ and $11_2$, respectively, and a common transport mechanism 12 operationally coupled between the ATM units $11_1$ and $11_2$.

ATM unit $11_1$ includes a dispenser $13_1$ for dispensing currency or bills of a first denomination, a diverter or flipper $15_1$ rotatable to either a clockwise (CW) or a counterclockwise (CCW) position, a flipper position sensor $17_1$, an output sensor $19_1$ and an output station $21_1$. The output station $21_1$ normally can include: an output receptable $23_1$ which may be comprised of a stacker wheel $25_1$ and a presenter plate $27_1$, a numeric keyboard $29_1$ (FIG. 4), a card reader (not shown) and a display (not shown).

The diverter $15_1$ is affixed to a shaft $31_1$ which is rotatably supported within a protective cabinet 32. One end of a link $33_1$ is fixed to the shaft $31_1$. The other end of link $33_1$ is pivotally joined to operating plunger $35_1$ of a solenoid $37_1$. One end of a spring $39_1$ is operatively connected to the other end of link $33_1$ as shown, while the other end of spring $39_1$ is connected to a fixed point $41_1$ so as to enable the diverter $15_1$ to channel a bill 42, that is dispensed from dispenser $13_1$, into a first path through the transport mechanism 12, into the stacker wheel $25_1$ whenever the solenoid $37_1$ is deenergized.

Similarly, the ATM unit $11_2$ includes elements $13_2$, $15_2$, $17_2$, $19_2$, $21_2$, $23_2$, $25_2$, $27_2$, $29_2$ (FIG. 4), $31_2$, $33_2$ (FIG. 2), $35_2$ (FIG. 2), $37_2$ (FIG. 2), $39_2$ (FIG. 2), $41_2$ (FIG. 2) and a card reader (not shown) and a display (not shown) which are respectively similar in structure and operation to the corresponding elements in ATM $11_1$, which elements in ATM $11_1$ (when shown) have the same integers as those in ATM $11_2$ but with a subscript of 1 instead of 2.

The transport mechanism 12 is comprised of drive rollers 50–59, follower rollers 60–73, a transport drive motor 75 and pulley and gear train assembly 77.

Rollers 50–73 may be made from rubber or a nonmarking black Neoprene material. The drive rollers 50–59 are driven by the shaft (not shown) of the transport drive motor 75 by way of the pulley and gear train assembly 77. Follower rollers 60–73 are positioned adjacent to the drive rollers 50–59 and are driven through compression contact with the drive rollers. Each of the drive rollers 50–59 rotates only in the direction of its associated arrow. As a result, each of the rollers 50–73 rotates only in one direction.

Depending on the velocity of the bills 42 being dispensed from either of the dispensers $13_1$ and $13_2$, the sizes of the pulleys (not shown) in the assembly 77 are such as to get the same surface velocity for the drive rollers 50–59 as that of the bills 42 being dispensed from one of the dispensers. Thus, the gear ratios in the pulley and gear train assembly 77 are preselected to get the same surface velocity or speed for each of the drive rollers 50–59 and, hence, for all of the rollers 50–73.

Bills 42 move edgewise from the dispensers $13_1$ and $13_2$ into and through the associated ones of the rollers 50–73. For ease of passing bills 42 edgewise through these rollers, successive nips of the roller pairs are positioned close together. To accomplish this purpose, two different diameters of drive rollers 50–59 are utilized, with the smaller diameter drive rollers 50, 53, 54, 57 and 58 having the higher RPM to get the same surface velocity or speed as the larger diameter drive rollers 51, 52, 55, 56 and 59.

Figure 2:
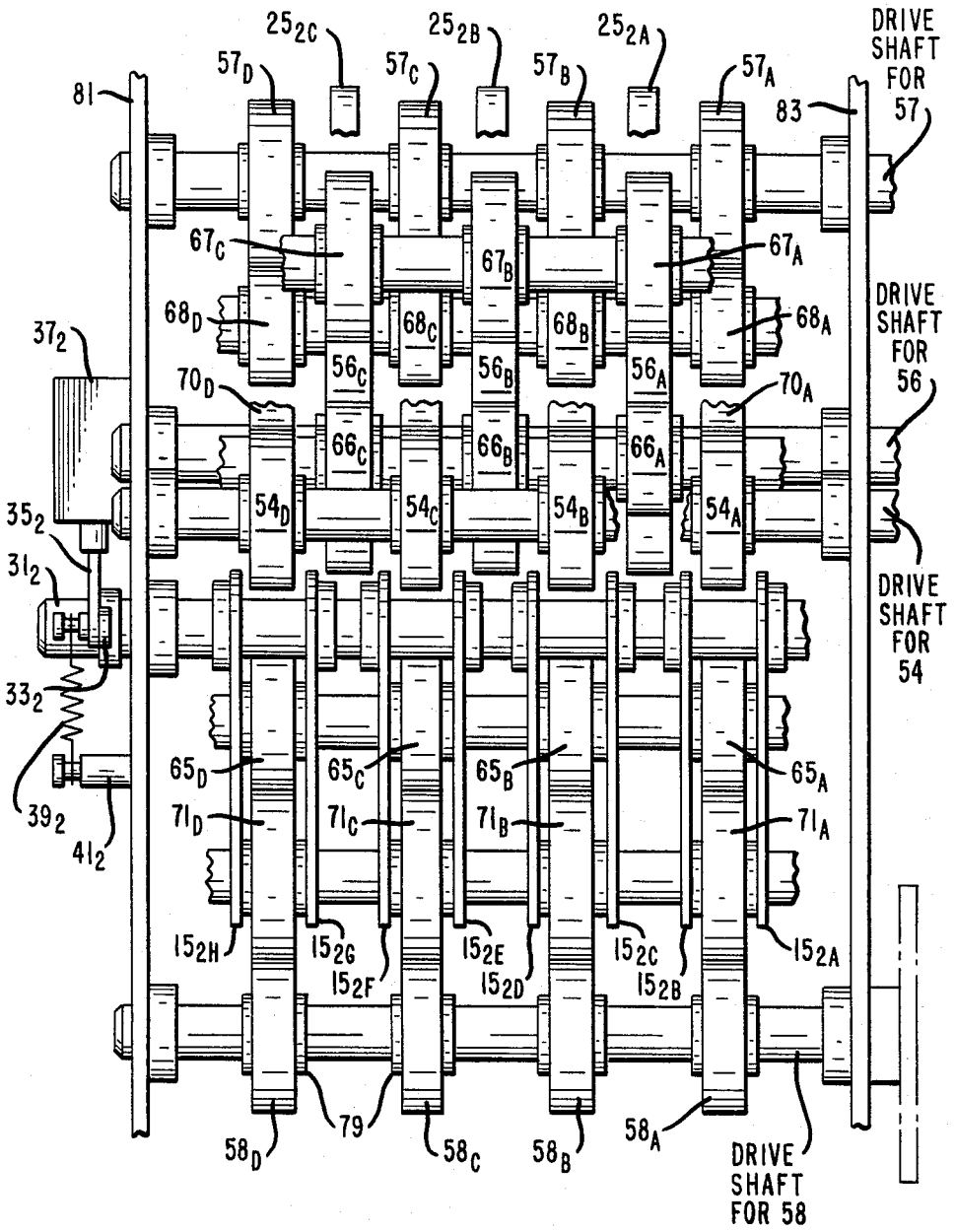
FIG. 2 is a cross-sectional view taken along the cut line 2—2 in FIG. 1.

To more clearly illustrate the operation of portions of FIG. 1, FIG. 2 will now also be discussed. FIG. 2 illustrates a cross-sectional view taken along the cut line 2—2 in FIG. 1. As shown in FIG. 2, each of the drive and follower rollers 50–73 shown in FIG. 1 represents an exemplary line of coaxially-aligned rollers, designated in FIG. 2 by the corresponding integer but with the subscripts A, B, C and D. Each line of drive and follower rollers 50–73 is spaced across the length of a bill 42 as the bill is passed therethrough.

Each line of rollers 50–73 is appropriately mounted on an associated common shaft by clips 79 to prevent side movement on the associated shaft. In addition, each line of drive and follower rollers 50–73 has each end of its associated shaft coupled through bearings mounted in vertical frame members 81 and 83 of protective cabinet 32 (FIG. 1). Furthermore, each line of drive rollers 50–59 has the end of its associated drive shaft that passes through frame member 83 also coupled to the pulley and gear train assembly 77.

Figure 3:
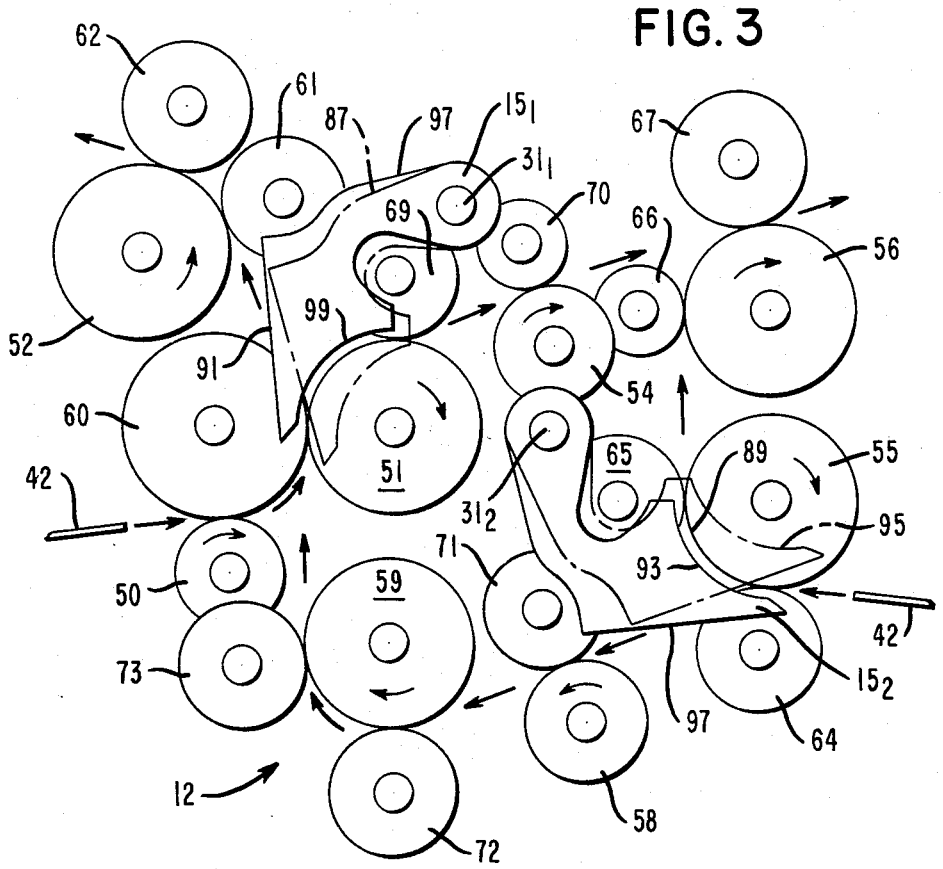
FIG. 3 illustrates the various possible currency paths, depending upon the positions of the flippers $\mathbf{15}_1$ and $\mathbf{15}_2$.

The diverter or flipper $15_2$ is comprised of an exemplary line of eight thin, flat flipper blades $15_{2A}$–$15_{2H}$ affixed or pinned to a common shaft $31_2$ which is rotatably supported by bearings in the frame members 81 and 83. Similarly, the diverter or flipper 15, is comprised of an exemplary line of eight thin, flat flipper blades (not shown) affixed to the shaft $31_1$ (FIG. 3). As shown in FIG. 2, a pair of flipper blades is mounted on each side of each roller in a roller line, such as 71 or 65 (or 64 as indicated in FIG. 1).

One end of a link $33_2$ is fixed to the shaft $31_2$, while the other end of the link $33_2$ is pivotally joined to the operating plunger $35_2$ of solenoid $37_2$. One end of spring $39_2$ is operatively connected to the other end of link $33_2$, while the other end of spring $39_2$ is connected to the fixed point $41_2$ to enable the diverter $15_2$ to channel a bill from dispenser $13_2$ into a second path through the transport mechanism 12, into the stacker wheel $25_2$ whenever the solenoid $37_2$ is deenergized.

Stacker wheel $25_2$ is comprised of an exemplary line of three wheels $25_{2A}$, $25_{2B}$ and $25_{2C}$. These wheels are affixed to a common shaft (not shown) (FIG. 1) which is rotatably supported by bearings (not shown) in the frame members 81 and 83. This shaft of stacker wheels $25_2$ is also coupled to appropriately selected gears (not shown) in the assembly 77 to cause the stacker wheel $25_2$ to be rotated at the desired velocity. Similarly, stacker wheel $25_1$ is comprised of an exemplary line of three wheels affixed to another common shaft (FIG. 1).

Dispensed bills are collected in respective slots in each of the wheels $25_{2A}$–$25_{2C}$ of the stacker wheel $25_2$ (or $25_1$), such as shown by slot 85 (FIG. 1). In this manner bills 42 are collected in respective slots 85 of the stacker wheel $25_2$. As the stacker wheel $25_2$ rotates in the direction shown by the associated arrow, bills are directed into the presenter plate $27_2$ to accumulate there in a stack 87 of bills 42. Another conveyor (not shown) could be utilized to convey the accumulated stack 87 to some other destination. It should, of course, be realized that the output receptacle $23_2$ can be comprised of, for example, simply a box or container to sequentially receive the bills 42, rather than a stacker wheel $25_2$ and presenter plate $27_2$. The stacker wheel $25_1$ operates in the same manner as the stacker wheel $25_2$.

The various possible currency paths through the transport mechanism 12 are shown in FIG. 3. These paths depend upon the relative positions (CW or CCW) of the flippers $15_1$ and $15_2$.

In normal operation, both of the solenoids $37_1$ (FIG. 1) and $37_2$ (FIG. 2) are deenergized. When solenoid $37_1$ is deenergized, flipper $15_1$ is in its normal or CCW position, as shown by the dashed outline 87. Similarly, when solenoid $37_2$ is deenergized, flipper $15_2$ is in its normal or CW position, as shown by the solid outline 89. FIG. 1 shows the flippers $15_1$ and $15_2$ in their normal positions for normal operation.

As shown in FIGS. 1 and 3, during normal operation dispenser $13_1$ can sequentially feed bills 42 between rollers 50 and 60, between rollers 51 and 60, along a straight edge 91 of flipper $15_1$, between rollers 52 and 61, between rollers 52 and 62 and between rollers 53 and 63 to the output receptacle $23_1$. In a similar manner, during normal operation dispenser $13_2$ can sequentially feed bills 42 between rollers 55 and 64, along a curved edge 93 of flipper $15_2$, between rollers 55 and 65, between rollers 56 and 66, between rollers 56 and 67 and between rollers 57 and 68 to output receptacle $23_2$.

When a customer requests currency from ATM $11_1$ and dispenser $13_1$ is either inoperative or out of currency, solenoid $37_1$ (FIG. 1) remains deenergized and solenoid $37_2$ (FIG. 2) is energized to pull flipper $15_2$ to its CCW position, as shown by the dashed outline 95. Bills 42 are then sequentially fed from the dispenser $13_2$ in ATM $11_2$, between rollers 55 and 64, along a straight edge 97 of flipper $15_2$, between rollers 58 and 71, between rollers 59 and 72, between rollers 59 and 73, between rollers 51 and 60, along the straight edge 91 of flipper $15_1$, between rollers 52 and 61, between rollers 52 and 62 and between rollers 53 and 63 to the output receptacle $23_1$ of requested ATM $11_1$. Thus, dispenser $13_2$ in ATM $11_2$ can alternately supply bills, when requested, to both the output receptacle $23_1$ of ATM $11_1$ and the output receptacle $23_2$ of ATM $11_2$ whenever dispenser $13_1$ is inoperative or out of bills. When dispenser $13_1$ is repaired or restocked with bills 42 and placed back in operation, normal operation is resumed with both of the solenoids $37_1$ (FIG. 1) and $37_2$ (FIG. 2) being deenergized.

Similarly, when a customer requests currency from ATM $11_2$ and dispenser $13_2$ is either inoperative or out of bills, solenoid $37_2$ (FIG. 2) is deenergized and solenoid $37_1$ (FIG. 1) is energized to pull flipper $15_1$ to its CW position, as shown by the solid outline 97. Bills 42 are then sequentially fed from the dispenser $13_1$ in ATM $11_1$, between rollers 50 and 60, between rollers 51 and 60, along a curved edge 99 of flipper $15_1$, between rollers 51 and 69, between rollers 54 and 70, between rollers 56 and 67 and between rollers 57 and 68 to the output receptacle $23_2$ of requested ATM $11_2$. Thus, dispenser $13_1$ in ATM $11_1$ can alternately supply bills, when requested, to both the output receptacle $23_2$ of ATM $11_2$ and the output receptacle $23_1$ of ATM $11_1$ whenever dispenser $13_2$ is inoperative or out of bills. When dispenser $13_2$ is repaired or restocked with bills 42 and placed back in operation, normal operation is resumed with both of the solenoids $37_1$ (FIG. 1) and $37_2$ (FIG. 2) being deenergized.

The distance between successive nips of roller pairs in the above-discussed dispensing paths through the transport mechanism is less than the minimum width of each bill 42 being dispensed.

It should be noted at this time that paper guides (not shown) may be selectively positioned among the assembly of rollers 50–73 to help guide the bills 42 in a dispensing path into and from the nips between associated roller pairs.

Referring now to FIG. 4, a schematic block diagram is illustrated of a control circuit which may be used to control the dispensing operations of components of FIG. 1.

Information signals from flipper position sensors $17_1$ and $17_2$ and output sensors $19_1$ and $19_2$ are respectively applied through buffer/drivers $101_1$, $101_2$, $103_1$, and $103_2$ to a peripheral interface adapter (PIA) 105 to a microprocessor 107.

It should be noted at this time that each of the sensors $17_1$, $17_2$, $19_1$ and $19_2$ can include a light emitting diode (LED) and a photosensor (not shown) oppositely positioned across a preselected portion of one of the dispensing paths. The passage of a bill 42 or one of the flippers $15_1$ and $15_2$ between a LED and its associated photosensor interrupts the light path therebetween, causing the photosensor to develop and apply a signal to the microprocessor 107 to indicate the obstruction across the associated dispensing path. In this manner, each of the output sensors $19_1$ and $19_2$ would generate a signal each time that a bill is outputted from the transport mechanism 12 past that sensor. Similarly, each of the flipper sensors $17_1$ and $17_2$ would generate a signal to indicate to the microprocessor 107 the position of the associated one of the flippers $15_1$ and $15_2$. For example, as shown in FIG. 1, both of the flippers are in their normal positions, each blocking the light path between the LED and photosensor in its associated one of the flipper sensors $17_1$ and $17_2$. When flipper solenoid $37_1$ ($37_2$) is energized, flipper $15_1$ ($15_2$) moves to its CW (CCW) position, unblocking the light path between the LED and photosensor in flipper sensor $17_1$ ($17_2$).

In the extraction of currency, each of the ATM units $11_1$ and $11_2$ requires a customer to insert his ATM credit card into the ATM unit. This credit card contains account information written on a magnetic stripe. The customer next enters into the selected one of the numeric keyboards $29_1$ and $29_2$ his personal ATM identification number which corresponds in a predetermined manner to the account information on his ATM credit card. Then the customer enters into the selected keyboard his requested currency amount.

Information signals from keyboards $29_1$ and $29_2$ are applied through respective associated buffer/driver circuits (not shown) to the microprocessor 107 by way of the PIA 105.

Upon receiving a request for currency, the microprocessor 107 starts extracting and executing a software program from a program read only memory (ROM) 109, using a random access memory (RAM) 111 to store temporary data in temporary memory locations. In the execution of the program from the ROM 109, the microprocessor basically performs the following operations.

In response to a request for currency from one of the keyboards $29_1$ and $29_2$, the microprocessor 107 first checks to see if the dispenser ($13_1$ or $13_2$) associated with the requesting one of the output stations $21_1$ and $21_2$ (FIG. 1) is not inoperative and not out of bills. If the associated dispenser was inoperative or out of bills the last time it was used, it would send signals to indicate that condition to the microprocessor 107 via an associated PIA. As shown in FIG. 4, the dispensers $13_1$ and $13_2$ are coupled to the microprocessor 107 by way of PIAs $113_1$ and $113_2$, respectively. If the associated dispenser is not inoperative and not out of bills, the microprocessor 107 then checks the flipper position sensors $17_1$ and $17_2$. The flipper position sensors $17_1$ and $17_2$ respectively send to the microprocessor 107 signals indicative of the positions of the flippers $15_1$ and $15_2$.

The microprocessor 107 will not enable one of the dispensers $13_1$ and $13_2$ to dispense bills until the flippers $15_1$ and $15_2$ are in the proper positions to transport the bills to the requesting one of the output stations $21_1$ and $21_2$. If the sensors $17_1$ and $17_2$ indicate that one or both of the associated flippers $15_1$ and $15_2$ are not in the proper positions to transport currency to the desired one of the output receptacles $23_1$ and $23_2$, the microprocessor 107 will selectively supply signals by way of PIA 105 to power drivers $115_1$ and $115_2$ to cause flipper solenoids $37_1$ and $37_2$ to respectively position the flippers $15_1$ and $15_2$ so that currency can be subsequently dispensed to the proper receptacle. Such positioning of the flippers $15_1$ and $15_2$ under various operating conditions has been previously discussed in relation to FIGS. 1–3.

After the flippers $15_1$ and $15_2$ have been correctly positioned in response to a keyboard request for currency, the microprocessor 107 then applies an energizing signal by way of power driver 117 to energize an AC relay 119. Upon being energized, relay 119 applies an AC voltage to the transport drive motor 75 which, in turn, starts driving the drive rollers 50–59 (FIG. 1) by way of the pulley and gear train assembly 77. Finally, after the drive rollers 50–59 have reached the proper surface speed, the microprocessor 107 sends an enabling signal to the associated one of the dispensers via its associated PIA to enable that dispenser to start sequentially dispensing bills to the proper one of the output receptacles $23_1$ and $23_2$.

Each bill from the dispensing dispenser passes through the transport mechanism 12 and past the associated one of the output sensors $19_1$ and $19_2$ before it goes to the output receptacle of the requesting output station. The associated output sensor sends a signal to the microprocessor 107 each time that a dispensed bill passes that output sensor. In this manner the microprocessor 107 keeps track of how many bills have been dispensed and knows when the associated dispenser has finished dispensing the amount of bills requested by a customer. When the requested amount of bills has been dispensed, the microprocessor 107 sends a disabling signal to the associated dispenser to stop that dispenser from dispensing any more bills of that denomination.

It should be noted at this time that each of the dispensers $13_1$ and $13_2$ can store bills of one denomination, such as twenty dollar bills in U.S. currency, in a first internal bill hopper (not shown) and bills of another denomination, such as five dollar bills in U.S. currency, in a second internal bill hopper (not shown). Such a dispenser is described in U.S. Pat. No. 4,179,031.

When the dispensers $13_1$ and $13_2$ are each implemented to contain two different internal bill hoppers, as described in U.S. Pat. No. 4,179,031, the microprocessor 107 can enable the associated dispenser to dispense bills of a second denomination. The dispensing operation for the second denomination of bill would be the same as that previously discussed for the first denomination of bill and, hence, need not be further discussed. However, whenever two-denomination bill dispensers are used in the invention, different dispensing paths through the transport mechanism 12 would be utilized. Such dispensing paths from the dispensers $13_1$ and $13_2$, while not shown, are similar to the dispensing paths previously discussed. For these additional dispensing paths the system would require additional structure respectively similar to the transport mechanism 12, flippers $15_1$ and $15_2$, solenoids $37_1$ and $37_2$, sensors $17_1$, $17_2$, $19_1$ and $19_2$, buffer drivers $101_1$, $101_2$, $103_1$ and $103_2$, power drivers $115_1$ and $115_2$ and PIA 105.

After the associated dispenser has finished dispensing the correct amount of requested bills and is disabled by the microprocessor 107, the microprocessor 107 turns off the transport drive motor 75 to terminate the dispensing operation.

Structurally, each of the buffer/drivers $101_1$, $101_2$, $103_1$ and $103_2$ can be implemented by means of a Fairchild Semiconductor 7407 Hex Buffer/Driver; each of the power drivers $115_1$, $115_2$ and 117 can be implemented by mean of a Motorola MC 1413 High Current Darlington Driver; each of the PIAs 105, $113_1$ and $113_2$ can be implemented by means of a Motorola 6821 PIA; microprocessor 107 can be an Intel 8085 AH microprocessor; ROM 109 can be an Intel 2716 EPROM; and RAM 111 can be a Motorola 4116 B RAM.

Figure 5:
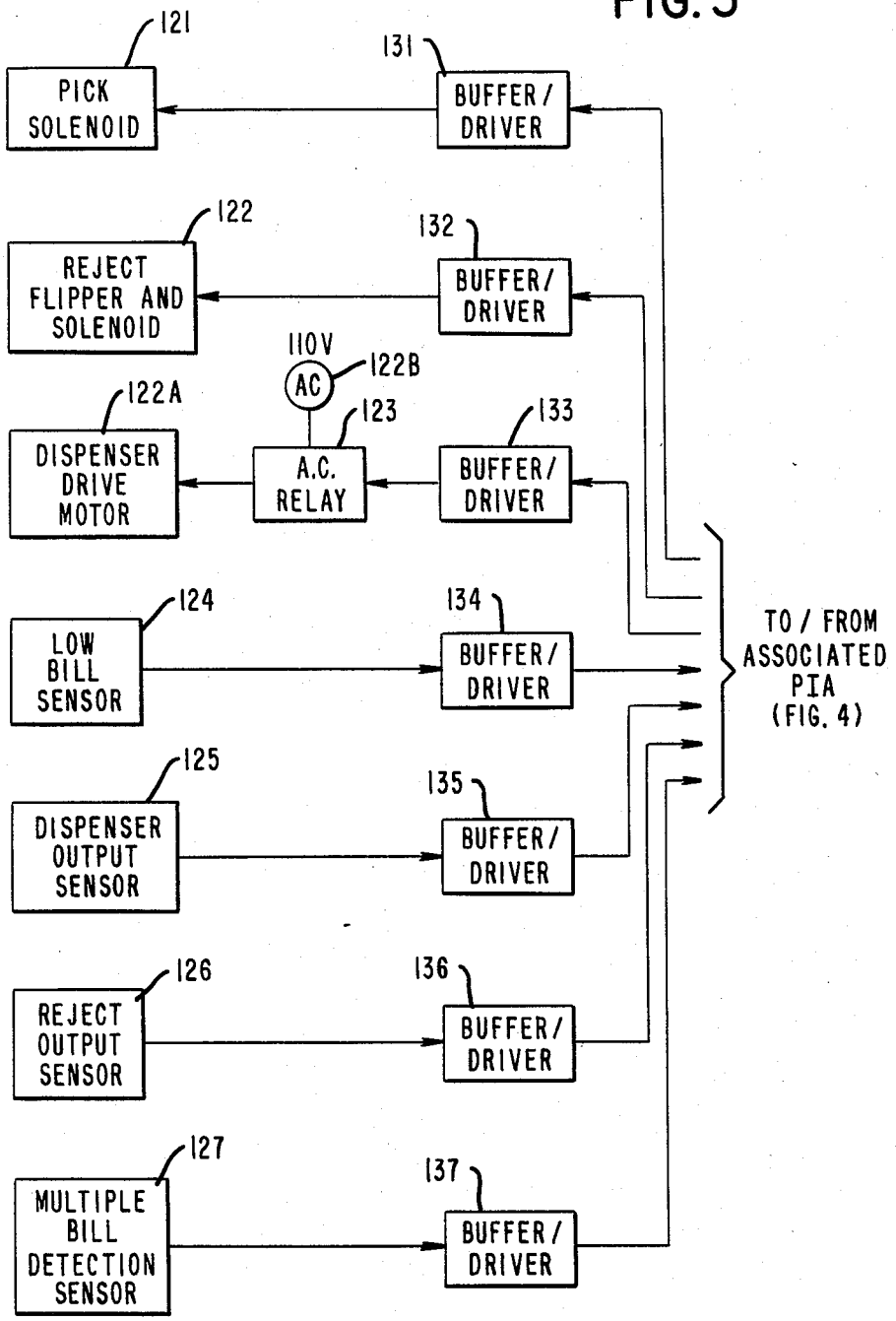
FIG. 5 is a schematic block diagram of sensing and control elements in one of the dispensers of FIG. 1.

Referring now to FIG. 5, a brief description will now be given of some of the sensing and control elements contained in each of the dispensers $13_1$ and $13_2$ of FIG. 1. Since the structure and operation of each of the dispensers $13_1$ and $13_2$ are similar, only one dispenser will be discussed.

Essentially, a dispenser is comprised of a pick solenoid 121, a reject flipper and solenoid 122, a dispenser drive motor 122A, a low bill sensor 124, a dispenser output sensor 125, a reject output sensor 126 and a multiple bill detection sensor 127. Dispenser drive motor 122A receives AC power from an AC power source 122B by way of a relay 123, whenever the relay 123 is energized. The elements 121, 122 and 123 through 127 are respectively coupled through buffer/drivers 131 through 137 to the microprocessor 107 by way of its associated one of the PIAs $113_1$ and $113_2$. Buffer/drivers 131–137 are similar to buffer/drivers $101_1$, $101_2$, $103_1$ and $103_2$ shown in FIG. 4.

Signals from the sensors 124–127 indicate to the microprocessor 107 the status of these sensors. In response to a customer request for currency and to the status of signals from the sensors 124–127, the microprocessor 107 outputs signals to control the operations of the pick solenoid 121, reject flipper and solenoid 122 and dispenser drive motor 122A, as discussed below.

After receiving a customer request for bills, the microprocessor 107 sends a signal through buffer/driver 133 to energize the relay 123 to start the dispenser drive motor 122A. Then microprocessor 107 sends a signal to pick solenoid 121 to actuate the picking device (not shown) that picks a bill (not shown) from a bill hopper (not shown) and feeds it along a dispensing path (not shown) within the dispenser. As the picked bill enters the dispensing path, it goes through the multiple bill detection sensor 127, which determines if it is one or more bills. If a multiple bill is sensed by the sensor 127, the microprocessor 107 sends a signal to the reject flipper and solenoid 122 to energize a reject solenoid (not shown) to reposition a reject flipper (not shown) in order to reroute the double bill into a reject bin or hopper (not shown).

As soon as the multiple bill leaves the dispensing path and goes into the reject hopper, the reject output sensor 126 sends a signal to the microprocessor 107 to indicate that the multiple bill has been rejected. The microprocessor 107 then resets the reject flipper in reject flipper and solenoid 122 to its normal position and re-energizes the pick solenoid 121 to cause the picking device to pick and dispense another bill to take the place of the multiple bill. If that bill is a single bill, it will be passed through the dispensing path and through the dispenser output sensor 125 into an output tray (not shown). The dispenser output sensor 125 then sends a signal to the microprocessor 107 to indicate that the bill has been successfully outputted from the dispenser. Microprocessor 107 then counts that bill as being dispensed from the dispenser.

The above dispenser operation would be repeated until the dispenser has dispensed the requested amount of currency.

The low bill sensor 124 sends a signal to the microprocessor 107 when the bill hopper is low on bills. As a consequence of such a signal, the microprocessor 107 would take the dispenser out of service, preventing any more bills from being dispensed from that dispenser until the dispenser is restocked with bills of that denomination.

Each of the dispensers $13_1$ and $13_2$ has a similar operation for dispensing bills of a second donomination, as described in previously mentioned U.S. Pat. No. 4,179,031.

For a more detailed description of the step-by-step sequence involved in the operation of the fail safe document dispensing system disclosed in FIGS. 1–5, reference is now made to FIGS. 6–14. These figures show the essential operational steps that are involved after a customer at output station $21_2$ has entered his credit card and ID number and made a currency request. As indicated previously, these operational steps are controlled by the microprocessor 107 during the execution of the software program that is extracted from the ROM 109. It should, of course, be realized that similar operational steps would be involved for a customer at output station $21_1$ making a currency request.

Since a currency request was initially made at output station $21_2$, the fail safe dispensing system first tries to dispense a bill from dispenser $13_2$ and send it to output station $21_2$. As a result, the microprocessor 107 first checks to see if dispenser $13_2$ is operational. If it is known to be bad from a previous dispensing operation, the program would move to node A and try to dispense a bill from dispenser $13_1$ to output station $21_2$.

If dispenser $13_2$ is still operational, low bill sensor 124 (FIG. 5) would be checked to find out if dispenser $13_2$ has enough bills. If there are not enough bills in dispenser $13_2$, a low currency failure would be flagged or logged for dispenser $13_2$ and the program would move to node A to try to dispense a bill from dispenser $13_1$ to output station $21_2$.

If dispenser $13_2$ is operational and contains enough bills, the system starts an operation to dispense a bill from dispenser $13_2$ to output station $21_2$. The first thing the system does is to set the flippers $15_1$ and $15_2$ in their proper positions to enable a bill from dispenser $13_2$ to pass through the transport mechanism 12 to output station $21_2$. First, solenoid $37_2$ is de-energized. This should cause flipper $15_2$ to be in its CW position. Flipper position sensor $17_2$ is tested to see if flipper $15_2$ is in its CW position. If flipper $15_2$ is not in its CW position, a transport mechanism 12 failure is logged and the program moves to exit Z to terminate the system operation.

If flipper $15_2$ is in its CW position, solenoid $37_1$ is de-energized to cause flipper $15_1$ to be in its CCW position. Flipper position sensor $17_1$ is then tested to see if flipper $15_1$ is in its CCW position. If flipper $15_1$ is not in its CCW position, a transport mechanism 12 failure is logged and the program moves to exit Z to terminate the system operation.

If both of flippers $15_1$ and $15_2$ are in their proper de-energized positions, the dispenser $13_2$ drive motor 122A (FIG. 5) and the transport drive motor 75 (FIG. 1) are both turned on and allowed to reach stable speeds.

The next routine is to pick a single bill in the dispenser $13_2$. The pick solenoid 121 (FIG. 5) is energized to cause a bill picker (not shown) to pick a bill from a bill hopper inside of the dispenser $13_2$. After a bill is picked, it is checked by the multiple bill detection sensor 127 (FIG. 5) to see if two or more bills were simultaneously picked. If sensor 127 indicates a multiple bill, the reject flipper and solenoid unit 122 (FIG. 5) is set to automatically detour the multiple bill to a reject hopper (not shown). Then the reject flipper and solenoid unit 122 is reset. In this manner, each multiple bill is rejected, while each single bill is passed.

After a single bill has been picked, the next routine is to move that picked bill from the bill picker to the dispenser $13_2$ output.

Whenever a single bill is picked and not rejected, the operation moves to node G at which time the multiple bill detection sensor 127 signals the microprocessor 107 to start a dispenser jam timer in the software program from the ROM 109. The time length of the dispenser jam timer is fixed since it is known how long it takes a bill to be moved past the output sensor 125 (FIG. 5) of dispenser $13_2$ after the bill is picked and not rejected.

After the dispenser jam timer is started, the microprocessor 107 waits to see if a bill moves past the output sensor 125 of the dispenser $13_2$ before the dispenser jam timer expires. If the dispenser jam timer expires before a bill is outputted, this means that the bill is jammed inside the dispenser $13_2$. In this case, a dispenser $13_2$ failure is logged, the transport drive motor 75 and the dispenser $13_2$ drive motor are both turned off, and the program move to node A to try to dispense a bill from dispenser $13_1$ to output station $21_2$.

If the bill is picked properly and is moved past the output sensor 125 of the dispenser $13_2$ before the dispenser jam timer expires, the next routine is to move that bill from the output of the dispenser $13_2$ through the transport mechanism 12 to the stacker wheel $25_2$ at output station $21_2$.

Each bill that exits from the dispenser $13_2$ causes the output sensor 125 of dispenser $13_2$ to signal the microprocessor 107 to start a fail safe jam timer in the software program from the ROM 109. The duration of the fail safe jam timer is fixed since the distance from the dispenser $13_2$ to the stacker wheel $25_2$ and the surface speed of the transport mechanism 12 are both known.

After the fail safe jam timer is started the microprocessor 107 waits to see if a bill moves past output sensor $19_2$ (FIG. 1) before the fail safe jam timer expires. If the bill doesn't reach the output sensor $19_2$ before the fail safe jam timer expires, a transport mechanism 12 failure is logged. Because such a failure is very critical, the program then moves to exit Y to terminate the entire system operation.

If a bill is detected by the output sensor $19_2$ before the fail safe jam timer expires, and is thus delivered to the stacker wheel $25_2$ of output station $21_2$, the operation is finished for the dispensing of that bill. In such a case, the microprocessor 107 decrements the customer-requested number of bills by one and decides whether or not any more bills have to be dispensed by the dispenser $13_2$. If more bills have to be dispensed, the program goes back into the loop at node S and repeats the steps shown in FIGS. 7, 8 and 9 for each additional bill that has to be dispensed. When the total number of requested bills has been dispensed from dispenser $13_2$ to output station $21_2$, the dispensing operation is complete and the program moves to exit Y to terminate the entire system operation. At exit Y all of the motors are turned off, the flipper solenoids are deenergized and everything is powdered down to prevent any waste of power.

Figure 6:
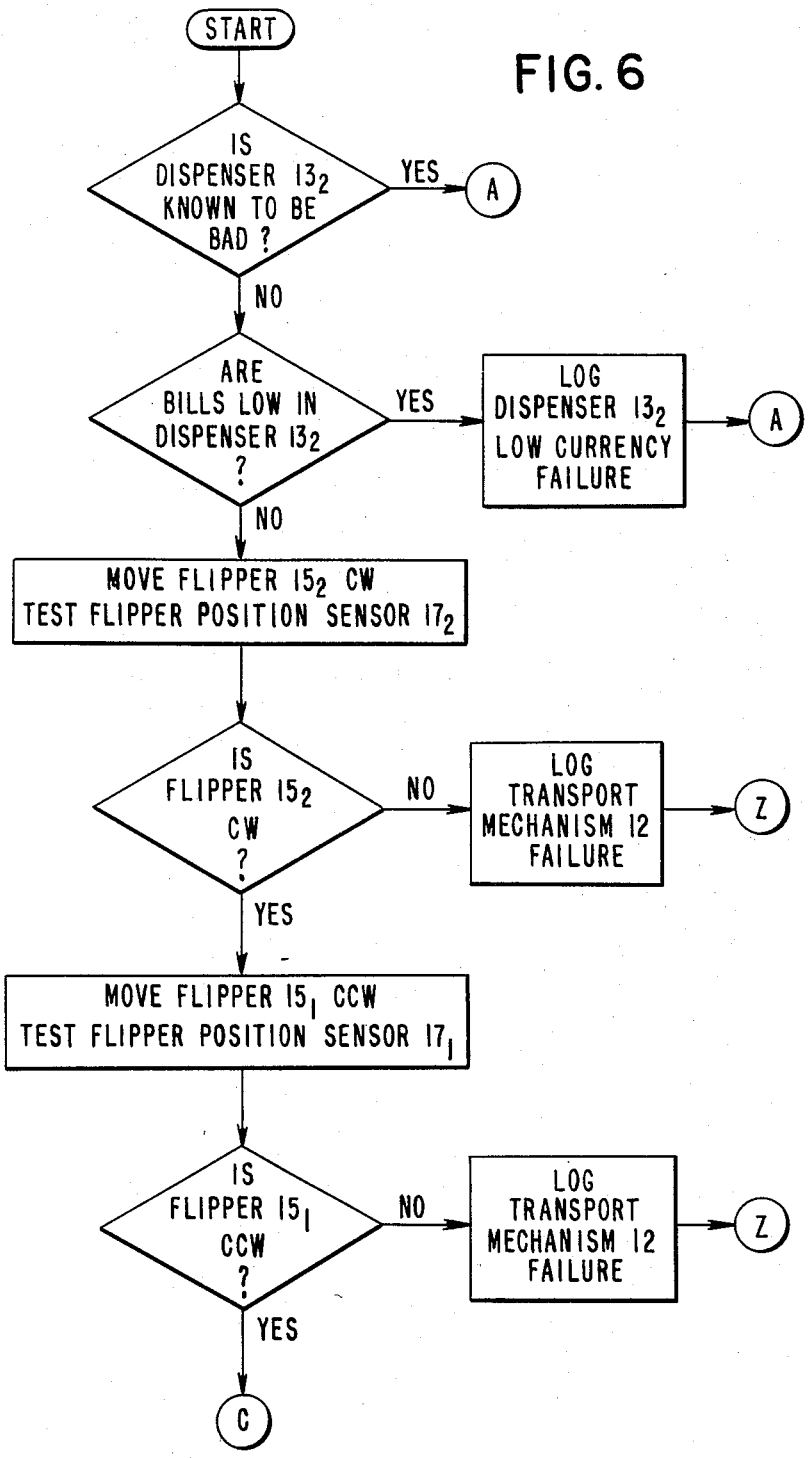
FIGS. 6–14 illustrate a flow diagram giving the steps in the operation of the fail safe dispensing system when a customer requests documents or currency from one of two dispensers in the system and that requested dispenser is inoperative or out of documents or currency.
Figure 7:
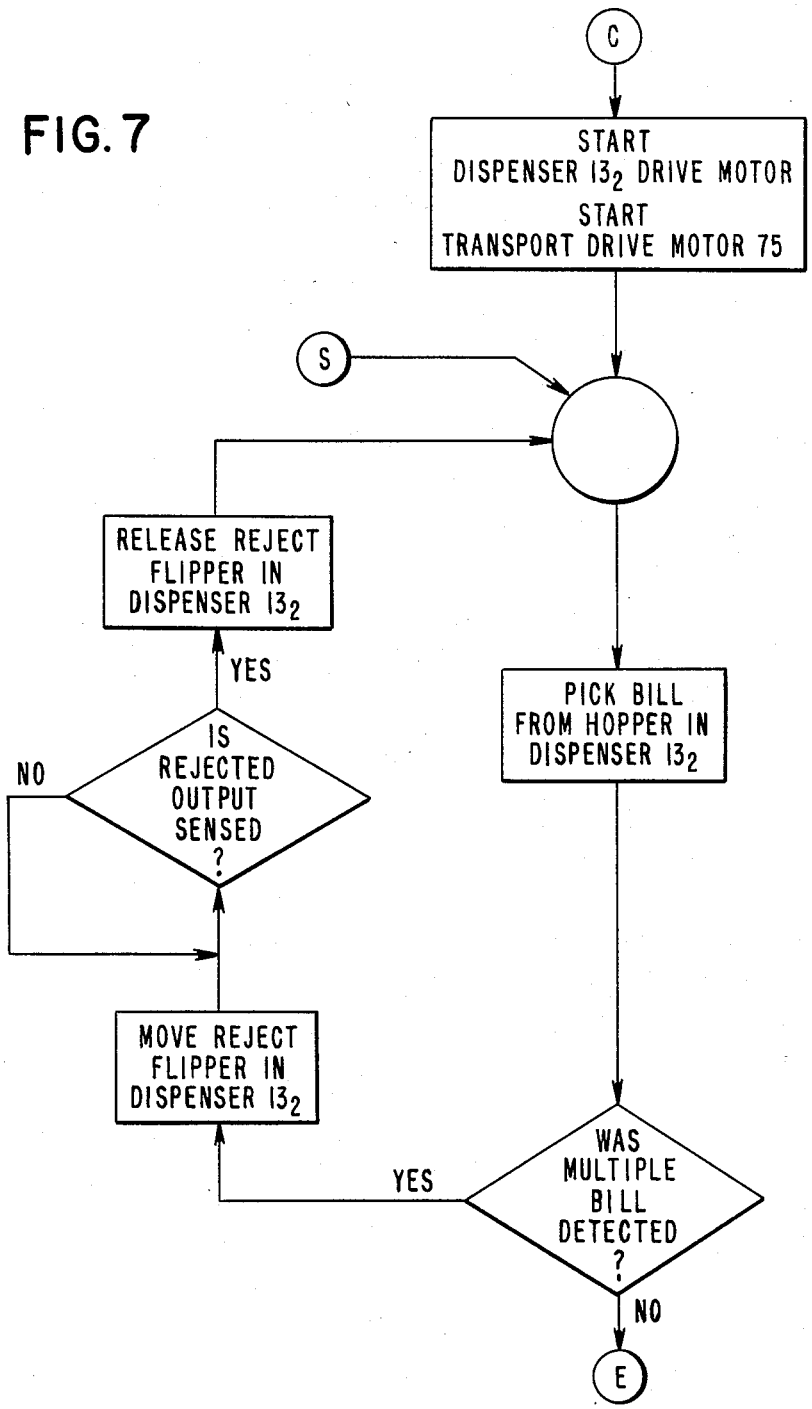
Figure 8:
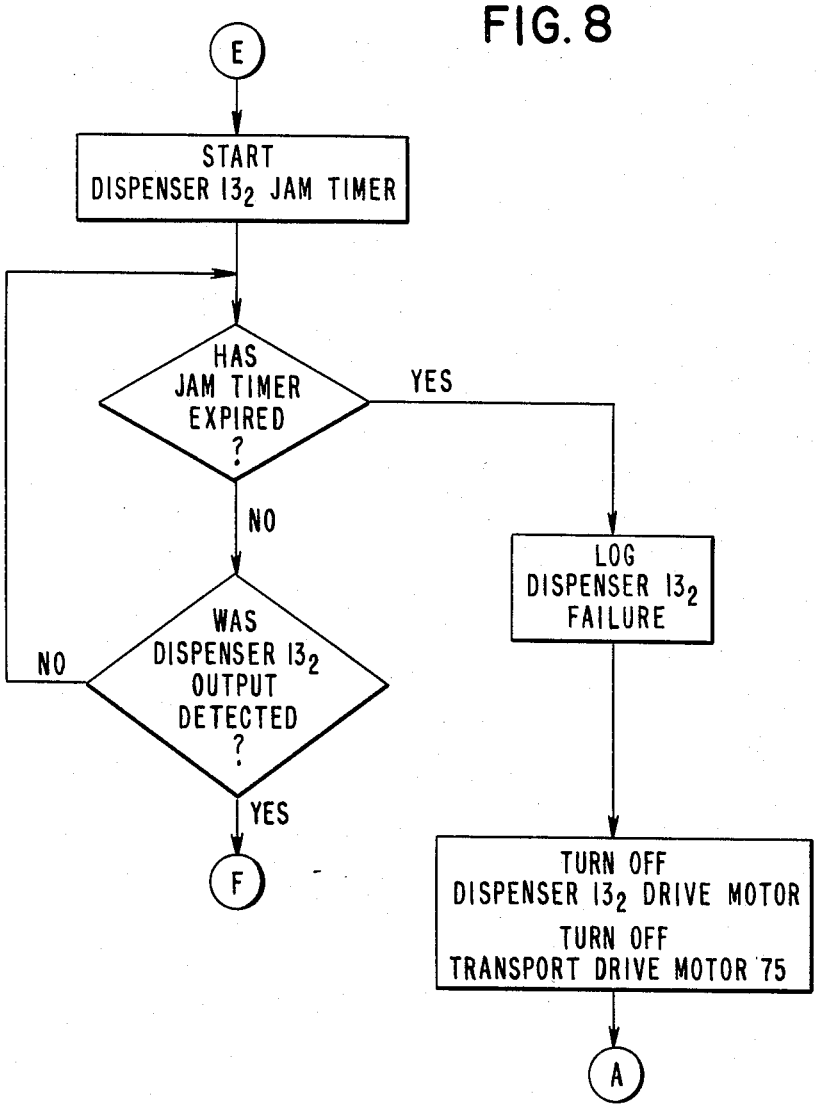
Figure 9:
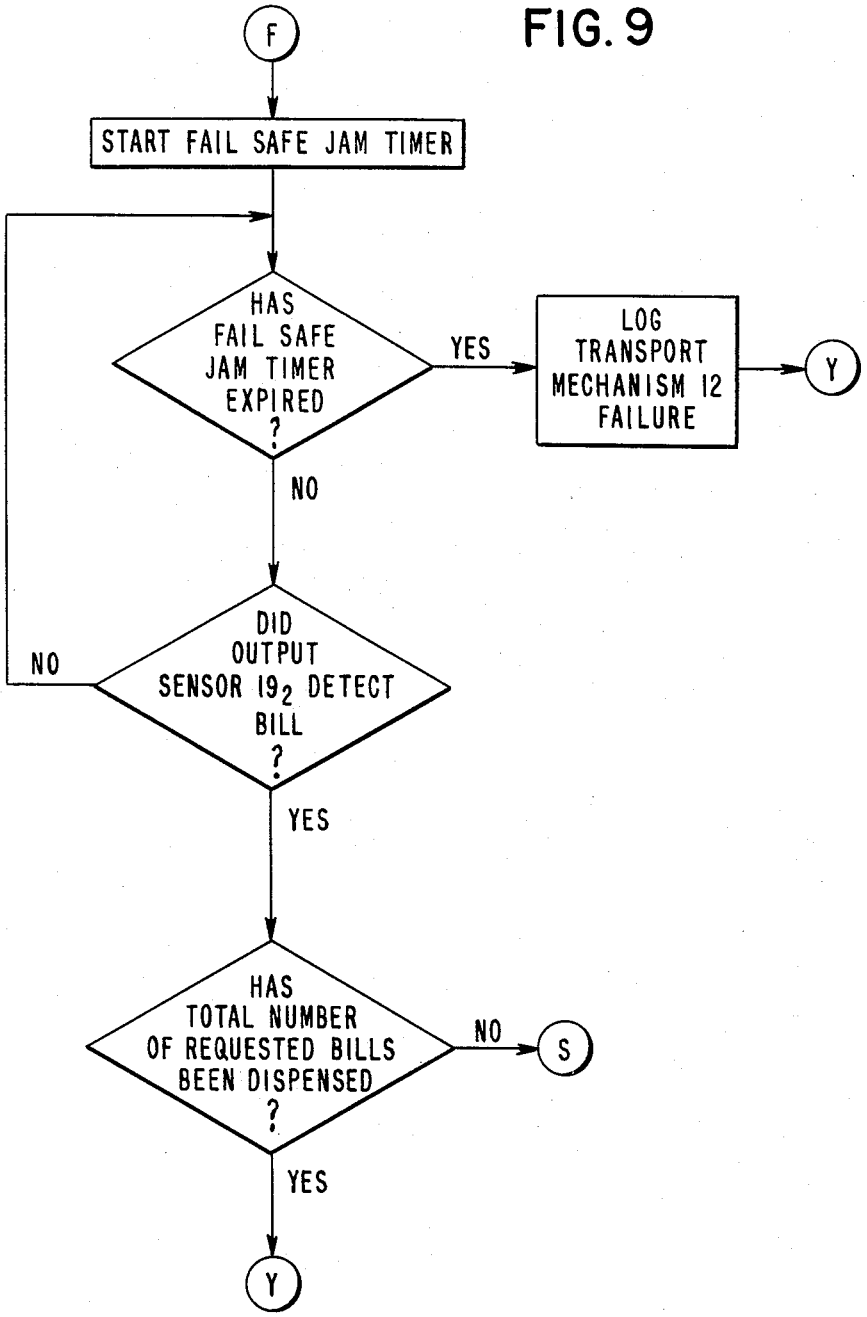
Figure 10:
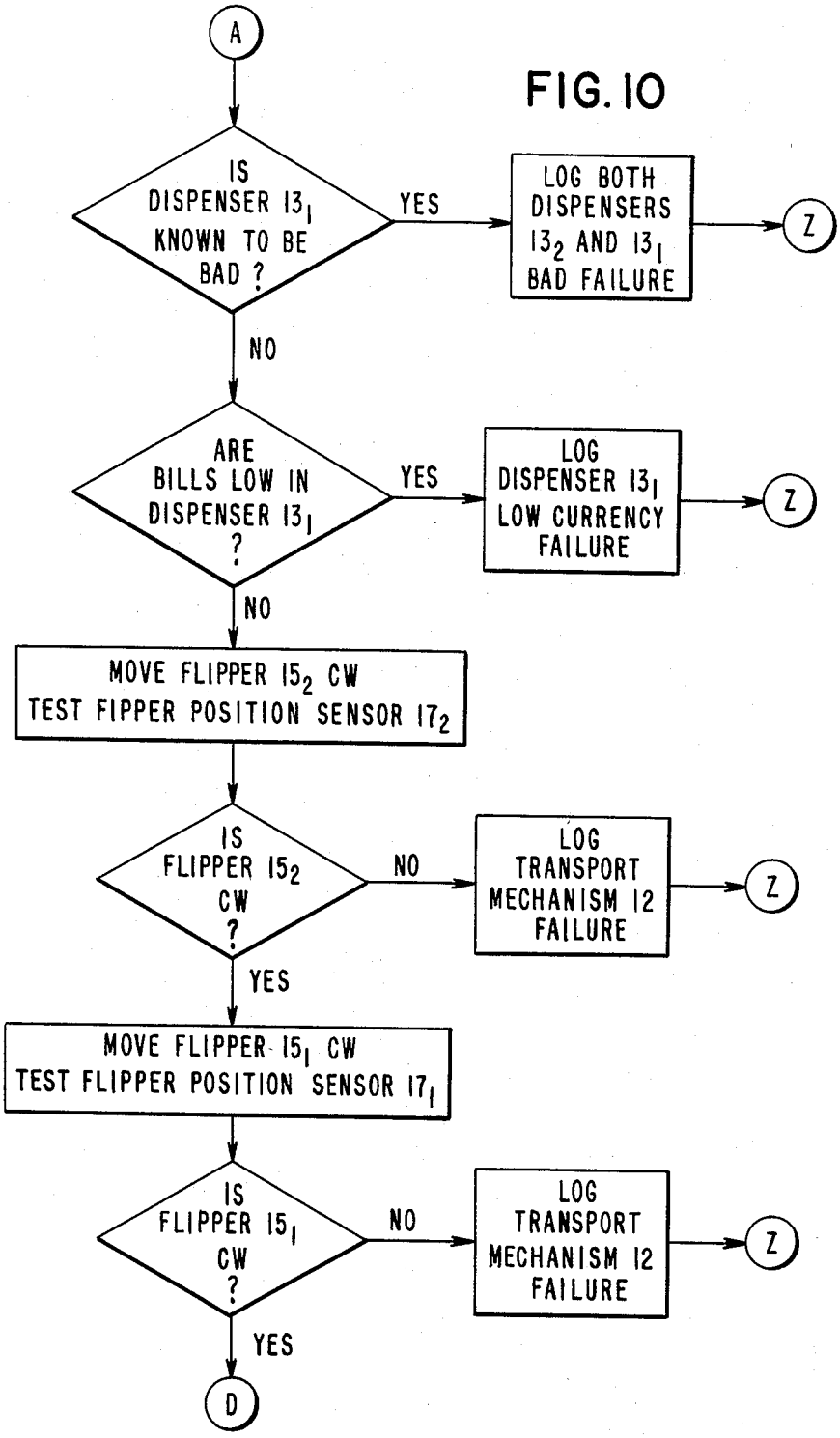
Figure 11:
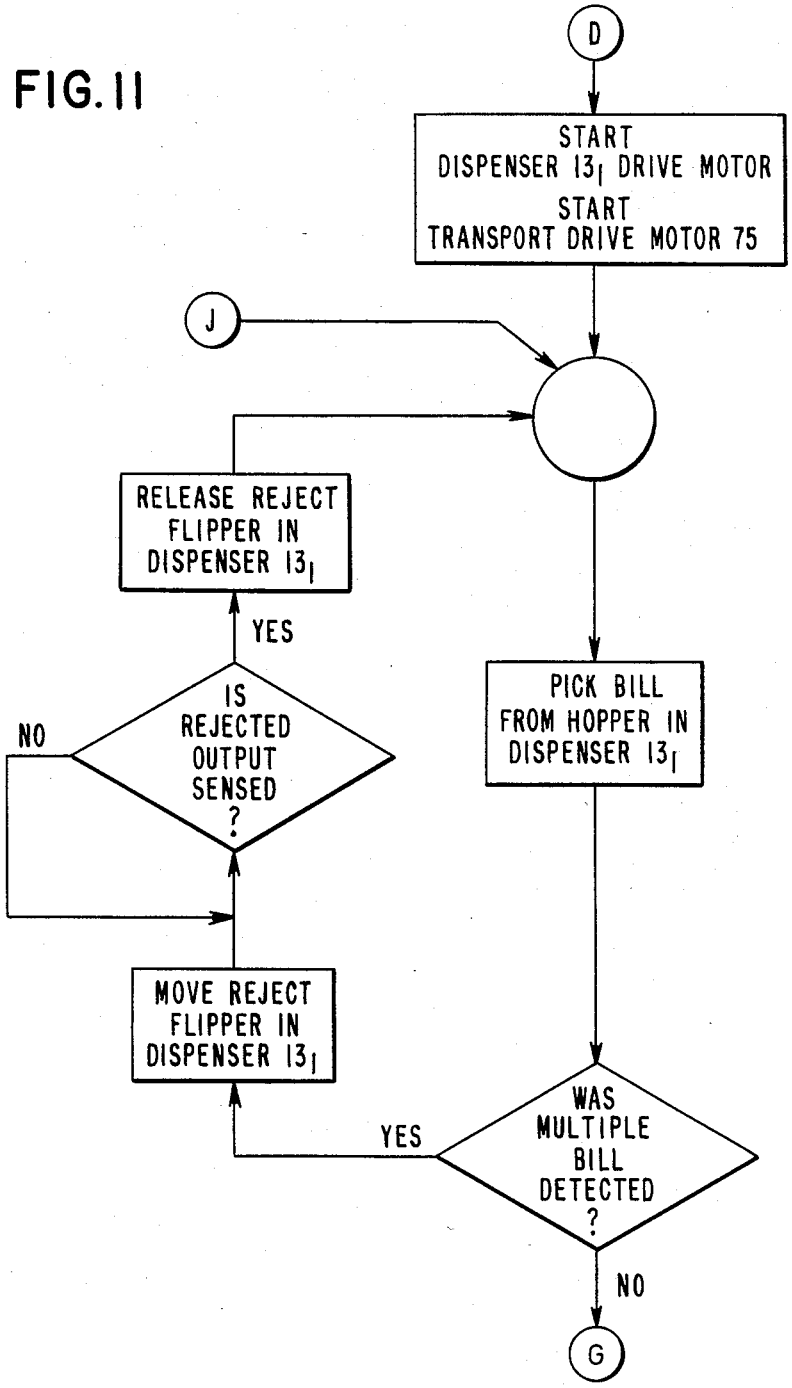
Figure 12:
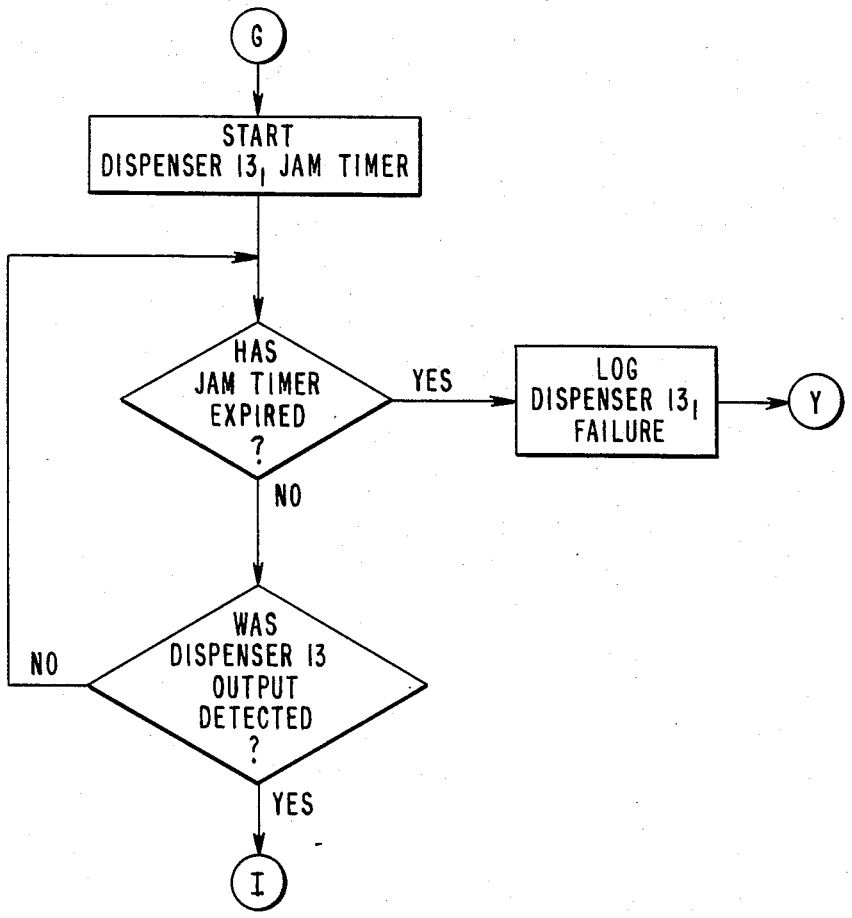
Figure 13:
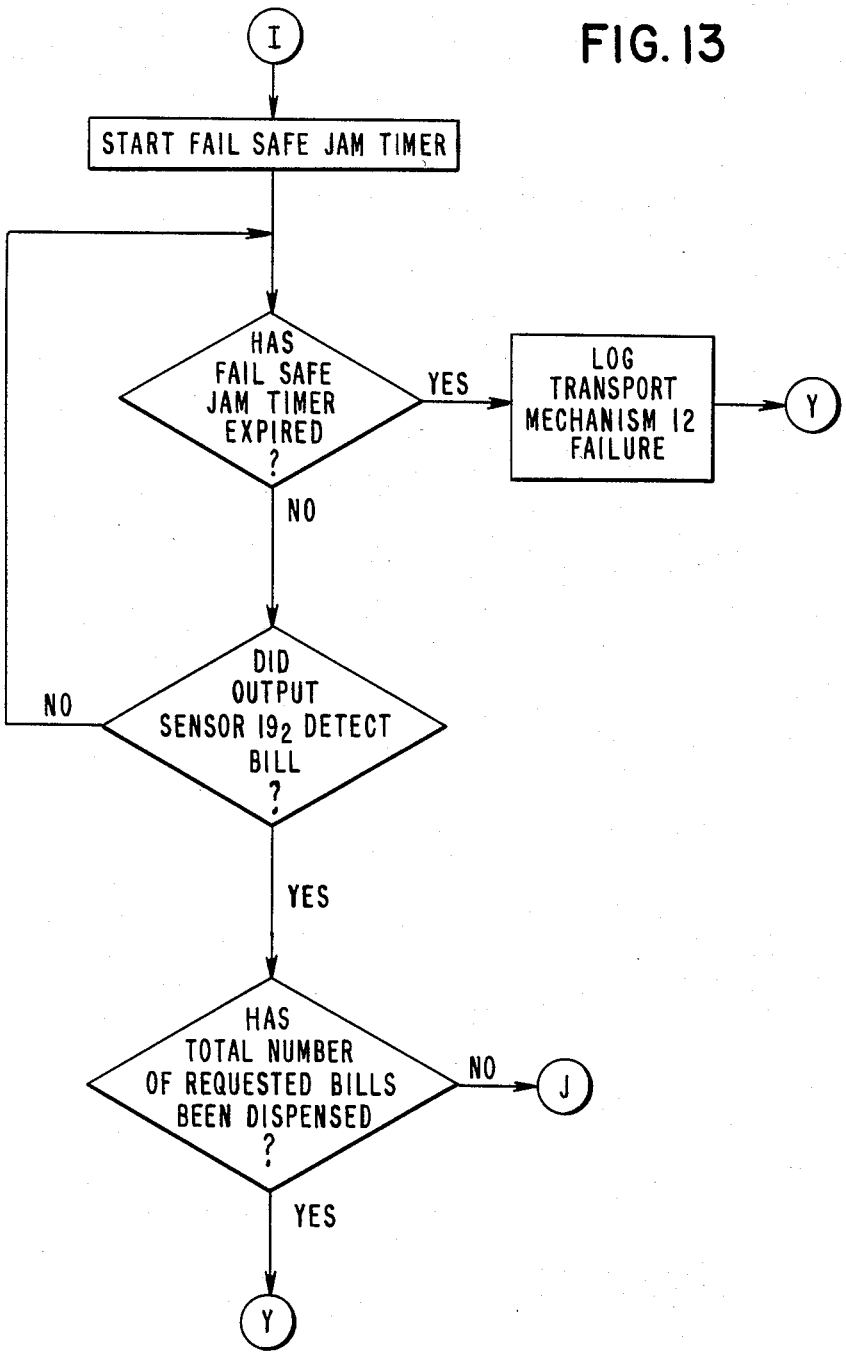

In relation to FIGS. 6 and 8 it was mentioned that if anything went wrong in trying to dispense a bill from dispenser $13_2$, the routine would branch to node A and attempt to dispense a bill from dispenser $13_1$ to output station $21_2$. Routine A will now be examined.

The operational steps involved from routine A on, as shown in FIGS. 10–13, are similar to the previously discussed operational steps shown in FIGS. 6–9. At the start of routine A, all of the motors have been turned off and the flipper solenoids $37_1$ and $37_2$ are in their de-energized states.

The microprocessor 107 first checks to see if dispenser $13_1$ is operational. If it is known to be bad from a previous dispensing operation, the program would log a failure for both of dispensers $13_1$ and $13_2$ and move to exit Z to terminate the system operation because neither dispenser is operative.

If dispenser $13_1$ is still operational, microprocessor 107 checks the low bill sensor 124 (FIG. 5) to find out if dispenser $13_1$ has enough bills. If there are not enough bills in dispenser $13_1$, a low currency failure would be logged for dispenser $13_1$ and the program would move to exit Z to terminate the system operation because neither dispenser is operative.

Since the initial currency request was made at output station $21_2$ and dispenser $13_2$ is inoperative, the fail safe system will try to move a bill from dispenser $13_1$ to output station $21_2$. Because the dispenser $13_1$ of ATM $11_1$ will be used to supply currency to the output station $21_2$ of ATM $11_2$, the flippers $15_1$ and $15_2$ may have to be in different positions. Consequently, the microprocessor 107 will de-energize solenoid $37_2$ to move flipper $15_2$ to its CW position and then test flipper position sensor $17_2$ to see if flipper $15_2$ is CW. Next, the microprocessor 107 will energize solenoid $37_1$ to move flipper $15_1$ to its CW position and then test flipper position sensor $17_1$ to see if flipper $15_1$ is CW. If either of the flippers $15_1$ and $15_2$ is not in its CW position, a transport mechanism 12 failure is logged and the program moves to exit Z to terminate the fail safe system operation.

If both of flippers $15_1$ and $15_2$ are in their CW positions, the drive motor 122A (FIG. 5) of the dispenser $13_1$ and the transport drive motor 75 (FIG. 1) are turned on and allowed to reach stable speeds. Then a bill is picked by a bill picker (not shown) from a hopper inside of the dispenser $13_1$ by energizing the pick solenoid 121 (FIG. 5) in that dispenser $13_1$. After the bill is picked it is checked by the multiple bill detection sensor 127 (FIG. 5) in dispenser $13_1$ to see if two or more bills were simultaneously picked. If a multiple bill is detected, the reject flipper and solenoid unit 122 (FIG. 5) of dispenser $13_1$ is set to automatically detour the multiple bill to a reject hopper (not shown) in dispenser $13_1$. Then the reject flipper and solenoid unit 122 is reset to its normal position.

Another bill is picked and tested for a multiple bill. If another multiple bill is detected, it is rejected in the same manner discussed above. If a single bill is picked and no multiple bill is detected, the operation moves to node G where a dispenser jam timer is started in the software program from the ROM 109 as the bill is moved from the multiple bill detection sensor 127 toward the output sensor 125 of the dispenser $13_1$. If the dispenser jam timer expires before a bill passes the output sensor 125 of dispenser $13_1$, a dispenser $13_1$ failure is logged and the program moves to exit Y to terminate the entire system operation.

It should be noted that the expiration of the jam timers for both of the dispensers $13_2$ and $13_1$ produces different system operations. If the jam timer initially fails for dispenser $13_2$, dispenser $13_1$ can be tried. However, if there is also a jam in dispenser $13_1$, there is no other dispenser to try and the system operation must be terminated. Although, this was the operation that was described above, it should be realized that fail safe systems utilizing three or more ATMs could be implemented within the purview of this invention.

If the bill is picked properly and is moved past the output sensor 125 of dispenser $13_1$ before the dispenser jam timer expires, the next routine is to move that bill from the output of the dispenser $13_1$ through the transport mechanism 12 to the stacker wheel $25_2$ at output station $21_2$.

Each bill that exits from the dispenser $13_1$ causes the output sensor 125 of dispenser $13_1$ to signal the microprocessor 107 to start the fail safe jam timer in the software program from the ROM 109. The duration of the fail safe jam timer is fixed by the surface speed of the transport mechanism 12 and the longer of the two distances from the dispensers $13_1$ and $13_2$ to the stacker wheel $25_2$ of the output station $21_2$.

If the fail safe jam timer expires before the bill from dispenser $13_1$ reaches stacker wheel $25_2$, this means that the bill has become jammed in the transport mechanism 12. In such a case, a transport mechanism 12 failure is logged and the program then moves to exit Y to terminate the entire system operation.

If the bill is detected by the output sensor $19_2$ before the fail safe jam timer expires, and is thus delivered to the stacker wheel $25_2$ of output station $21_2$, the operation is finished for the dispensing of that bill. The microprocessor 107 then decrements the customer-requested number of bills by one and decides whether or not any more bills have to be dispensed by dispenser $13_1$. If more bills have to be dispensed, the program goes back into the loop at node J and repeats the steps shown in FIGS. 11, 12 and 13 for each additional bill that has to be dispensed. When the total number of requested bills has been dispensed from dispenser $13_1$ to output station $21_2$, the dispensing operation is complete and the program moves to exit Y to terminate the entire system operation.

Figure 14:
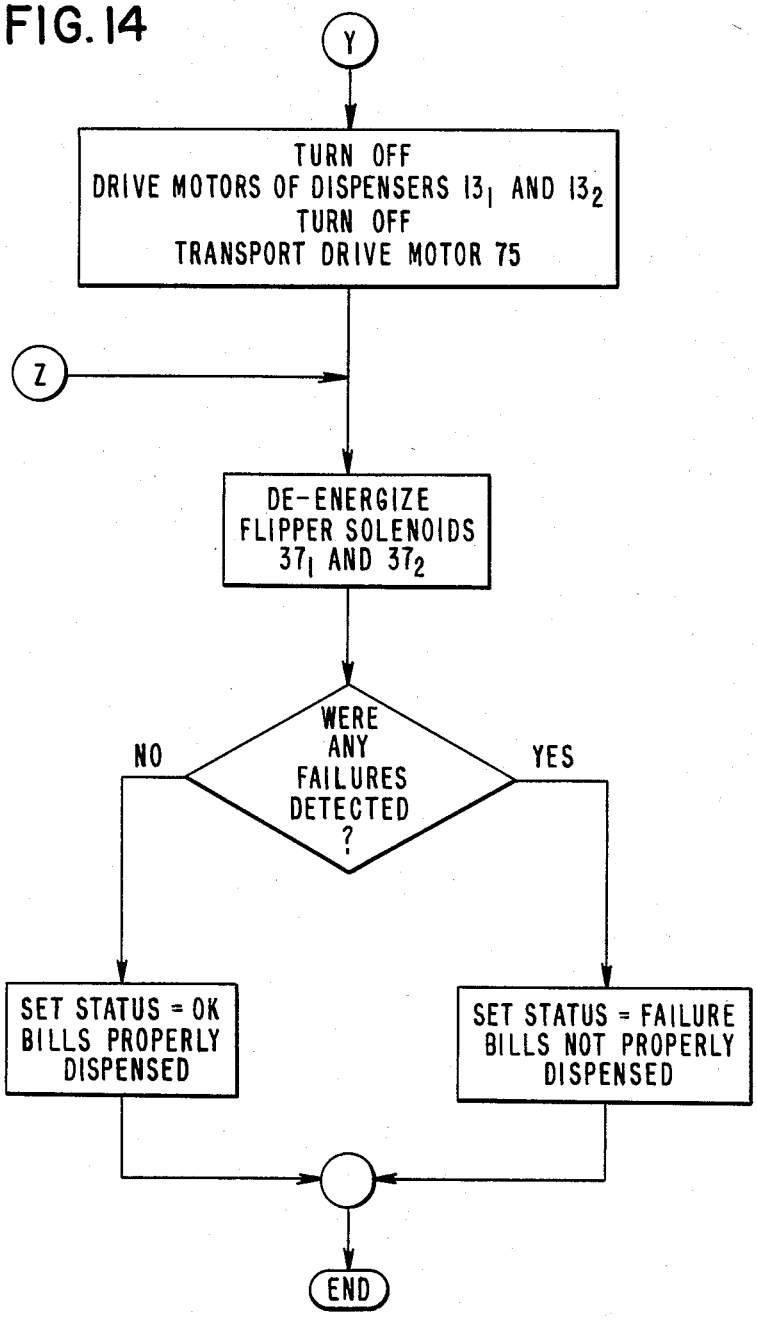

FIG. 14 illustrates the operational steps involved in exits Y and Z. At exit Y, the transport drive motor 75 and the drive motors of dispensers $13_1$ and $13_2$ are all turned off. Since none of these motors was on at exit Z, exit Z enters the operation at this time. Then the flipper solenoids $37_1$ and $37_2$ are deenergized. In this manner the fail safe system is set to an idle state to conserve power. As a convenience, a status bit is then set to indicate whether or not the dispensing operation was successfully completed. The system operation is then ended.

The invention thus provides a system and method for automatically and mutually sharing the currency dispensers in adjacent ATMs when one dispenser is either out of service because of a malfunction or out of currency.

While the salient features of the invention have been illustrated and described, it should be readily apparent to those skilled in the art that many changes and modifications can be made in the system and method of the invention presented without departing from the spirit and true scope of the invention. Accordingly, the present invention should be considered as encompassing all such changes and modifications of the invention that fall within the broad scope of the invention as defined by the appended claims.

We claim:

1. An article dispensing system comprising:

first and second article dispensing subsystems, each of said article dispensing subsystems comprising:

dispensing means responsive to a first signal for either sequentially dispensing articles therefrom or for generating a second signal when no articles are being dispensed therefrom;

an output receptacle;

conveying means for feeding articles from said dispensing means to said output receptacle; and diverter means being responsive to a third signal for diverting articles from said associated dispensing means to said output receptacle of the other one of said article dispensing subsystems; and means being responsive to said second signal from one of said subsystems for selectively generating first and third signals to cause articles to be fed to said output receptacle in said one of said subsystems from said dispensing means in the other one of said subsystems.

2. A document dispensing system comprising:

first dispensing means responsive to a first signal for either sequentially dispensing documents therefrom or for generating a second signal when no documents are being dispensed therefrom;

second dispensing means responsive to a third signal for either sequentially dispensing documents therefrom or for generating a fourth signal when no documents are being dispensed therefrom;

first and second output stations;

transport means for conveying documents from said first dispensing means into a first path to said first output station and documents from said second dispensing means into a second path to said second output station;

first diverter means in said first path being responsive to a fifth signal for diverting documents in said first path to said second output station;

second diverter means in said second path being responsive to a sixth signal for diverting documents in said second path to said first output station; and means responsive to a second signal for producing said third and fifth signals or to a fourth signal for producing said first and sixth signals.

3. The system of claim 2 wherein said transport means includes:

a transport drive motor;

a pulley and gear train assembly driven by said transport drive motor;

a plurality of drive rollers driven by said pulley and gear train assembly; and a plurality of follower rollers driven by said plurality of drive rollers, said plurality of drive rollers and said plurality of follower rollers cooperating to selectively pass documents from at least one of said first and second dispensing means to at least one of said first and second output stations.

4. The system of claim 3 wherein said transport means feeds documents therethrough at a substantially constant speed.

5. The system of claim 2 having the capability of selectively dispensing first and second types of documents from either of said first and second dispensing means to either of said first and second output stations.

6. The system of claim 2 wherein each of said first and second output stations includes a stacking mechanism for evenly stacking documents successively transported by said transport means into said output station.

7. The system of claim 2 wherein each of said first and second output stations includes an output receptacle for receiving documents transported thereto from said transport means.

8. The system of claim 2 wherein:

said first dispensing means includes a first sensor for generating the second signal when no documents are being dispensed from said first dispensing means; and said second dispensing means includes a second sensor for generating the fourth signal when no documents are being dispensed from said second dispensing means.

9. A document dispensing system comprising:

first dispensing means responsive to a first signal for either sequentially dispensing documents therefrom or for generating a second signal when no documents are being dispensed therefrom;

second dispensing means responsive to a third signal for either sequentially dispensing documents therefrom or for generating a fourth signal when no documents are being dispensed therefrom;

first and second output stations;

transport means for conveying documents from said first dispensing means into a first path to said first output station and documents from said second dispensing means into a second path to said second output station;

first diverter means in said first path being responsive to a fifth signal for diverting documents in said first path to said second output station, said first diverter means including a first diverter in the first path and a first control means for causing said first diverter to pass documents in the first path to either the first or second output station in response to the absence or presence, respectively, of the fifth signal;

second diverter means in said second path being responsive to a sixth signal for diverting documents in said second path to said first output station, said second diverter means including a second diverter in the second path and a second control means for causing said second diverter to pass documents in the second path to either the second or first output station in response to the absence or presence, respectively, of the sixth signal; and means responsive to a second signal for producing said third and fifth signals or to a fourth signal for producing said first and sixth signals.

10. The system of claim 9 wherein each of said first and second control means is a solenoid.

11. A document dispensing system comprising:

first dispensing means responsive to a first signal for either sequentially dispensing documents therefrom or for generating a second signal when no documents are being dispensed therefrom, said first dispensing means including a first sensor for generating the second signal when no documents are being dispensed from said first dispensing means;

second dispensing means responsive to a third signal for either sequentially dispensing documents therefrom or for generating a fourth signal when no documents are being dispensed therefrom, said second dispensing means including a second sensor for generating the fourth signal when no documents are being dispensed from said second dispensing means;

first and second output stations;

transport means for conveying documents from said first dispensing means into a first path to said first output station and documents from said second dispensing means into a second path to said second output station;

first diverter means in said first path being responsive to a fifth signal for diverting documents in said first path to said second output station, said first diverter means including a first diverter in the first path and a first control means for causing said first diverter to pass documents in the first path to either the first or second output station in response to the absence or presence, respectively, of the fifth signal;

second diverter means in said second path being responsive to a sixth signal for diverting documents in said second path to said first output station, said second diverter means including a second diverter in the second path and a second control means for causing said second diverter to pass documents in the second path to either the second or first output station in response to the absence or presence, respectively, of the sixth signal; and means responsive to a second signal for producing said third and fifth signals or to a fourth signal for producing said first and sixth signals.

12. The system of claim 11 wherein each of said first and second control means is a solenoid.

13. The system of claim 11 wherein said transport means includes:

a transport drive motor;

a pulley and gear train assembly driven by said transport drive motor;

a plurality of drive rollers driven by said pulley and gear train assembly; and a plurality of follower rollers driven by said plurality of drive rollers, said plurality of drive rollers and said plurality of follower rollers cooperating to selectively pass documents from at least one of said first and second dispensing means to at least one of said first and second output stations.

14. The system of claim 13 wherein said transport means feeds documents therethrough at a substantially constant speed.

15. The system of claim 13 having the capability of selectively dispensing first and second types of documents from either of said first and second dispensing means to either of said first and second output stations.

16. The system of claim 13 wherein each of said first and second output stations includes an output receptacle for receiving documents transported thereto from said transport means.

17. The system of claim 16 wherein each output receptacle is a stacking mechanism for evenly stacking received documents.

18. A method for selectively dispensing articles, said method comprising the steps of:

enabling a first dispenser to dispense articles in response to a first request for articles from a first output station and a second dispenser to dispense articles in response to a second request for articles from a second output station;

generating a first signal when the first dispenser is enabled and not dispensing articles or a second signal when the second dispenser is enabled and not dispensing articles;

feeding articles dispensed from the first dispenser along a first path and articles dispensed from the second dispenser along a second path; and diverting articles in the first path to either the first or second output station as a function of the respective absence or presence of the first signal or articles in the second path to either the second or first output station as a function of the respective absence or presence of the second signal.

19. The method of claim 18 wherein said generating step includes the steps of:

sampling a sensor at the output of each of the first and second dispensers to produce an output signal each time that a dispenser is dispensing an article; and utilizing the first request and the absence of a first output signal to produce the first signal or the second request and the absence of a second output signal to produce the second signal.

* * * * *